United States Patent [19]

Zansky

[11] 4,392,087

[45] Jul. 5, 1983

[54] TWO-WIRE ELECTRONIC DIMMING BALLAST FOR GASEOUS DISCHARGE LAMPS

[75] Inventor: Zoltan Zansky, Roseville, Minn.

[73] Assignee: Honeywell, Inc., Minneapolis, Minn.

[21] Appl. No.: 210,650

[22] Filed: Nov. 26, 1980

[51] Int. Cl.[3] ..... H05B 41/29

[52] U.S. Cl. ..... 315/219; 315/106; 315/225; 315/239; 315/244; 315/278; 315/291; 315/DIG. 4

[58] Field of Search ..... 315/209 R, 106, 219, 315/225, 232, 239, 244, 278, 282, 291, DIG. 4, DIG. 7

[56] References Cited

U.S. PATENT DOCUMENTS

| | | | |
|---|---|---|---|
| 3,247,422 | 4/1966 | Schultz | 315/206 |
| 3,710,177 | 1/1973 | Ward | 315/106 |
| 3,969,652 | 7/1976 | Herzog | 315/224 |
| 4,017,782 | 4/1977 | Wheeler | 321/2 |
| 4,042,852 | 8/1977 | Zaderes et al. | 315/97 |
| 4,163,925 | 8/1979 | Gyursanszky | 315/276 |
| 4,207,497 | 6/1980 | Capewell et al. | 315/96 |
| 4,207,498 | 6/1980 | Spira | 315/97 |
| 4,210,846 | 7/1980 | Capewell et al. | 315/121 |
| 4,259,614 | 3/1981 | Kohler | 315/244 X |

OTHER PUBLICATIONS

Cohen, Charles, "Transistor Ballast Cuts Power Loss", *Electronics* Sep. 13, 1979, pp. 78, 80.

Haver, Robert J., "The ABC's of DC to AC Inverters", *Motorola Semiconductor Products, Inc., Apr. 1975.*

Roddam, Thomas, "Transistor Inverters and Converters", Chapter 10 of *Design of Solid State Power Supplies*, Princeton, N.J.

Haver, Robert J., "The Verdict Is In: Solid-State Fluorescent Ballasts are Here", EDN Nov. 15, 1976.

*Primary Examiner*—Eugene R. LaRoche

*Attorney, Agent, or Firm*—Charles G. Mersereau

[57] ABSTRACT

A low cost high frequency electronic dimming ballast for gas discharge lamps is disclosed which eliminates the need for external primary inductance or choke coils by employing leakage inductance of the transformer. The system is usable with either fluorescent or high intensity discharge lamps and alternate embodiments employ the push-pull or half-bridge inverters. Necessary leakage inductance and tuning capacitance are both located on the secondary of the transformer. Special auxiliary windings or capacitors are used to maintain necessary filament heating voltage during dimming of fluorescent lamps. A clamping circuit or auxiliary tuned circuit may be provided to prevent component damage due to over-voltage and over-current if a lamp is removed during operation of the system.

29 Claims, 11 Drawing Figures

PRIOR ART

TWO-WIRE ELECTRONIC DIMMING BALLAST FOR GASEOUS DISCHARGE LAMPS

CROSS REFERENCE TO CO-PENDING APPLICATIONS

Cross-reference is made to two related applications. The first, Ser. No. 210,651, is entitled "Two-wire Electronic Dimming Ballast for Fluorescent Lamps" and has the same inventorship as the present application. The second related application, Ser. No. 210,649, entitled "Two-wire Ballast for Fluorescent Tube Dimming," was co-invented by Zoltan L. Zansky, an inventor in the present application. Both cross-referenced applications were filed of even date with the present application and are assigned to the same assignee as the present application.

The first cross-referenced application concerns a high frequency electronic ballast dimming arrangement which uses a resonant bridge inverter which may be dimmed by applying a pulse width modulated drive to the switching transistors or by variation of the AC source voltage to a rectification system. The second cross-referenced application concerns simplifying a conventional dimming ballast by eliminated the inductor or choke coil associated with maintaining the desired cathode filament voltage and replacing the function of the choke coil by providing secondary windings in the transformer which utilize the natural leakage inductance of the transformer to obtain the desired result. The present invention, on the other hand, concerns high frequency electronic ballast dimming arrangement which utilizes a pulse width modulated input drive or variable AC power supply source voltage to a current-fed inventor or half-bridge inverter in combination with the use of secondary windings which take advantage of the natural leakage inductance of the transformer to maintain the cathode filament voltage during dimming to simplify the system.

BACKGROUND OF THE INVENTION

1. Field of the Invention

The present invention relates generally to the field of two-wire, high frequency electronic ballasts for powering gas discharge tubes and the like and, more particularly, to a simplified two-wire electronic ballast arrangement which eliminates inductance external to the transformer and allows wide-range dimming.

2. Description of the Prior Art

Typical fluorescent tubes comprise a sealed cylinder of glass having a heating filament at either end and filled with a gas such as mercury vapor. The supplied voltage is utilized to heat the filaments to a point where a thermoionic emission occurs such that an arc can be struck across the tube causing the gas to radiate. Initial radiation given off by gases such as mercury vapor is of a short wavelength principally in the ultraviolet end of the spectrum and thus little visible light is produced. In order to overcome this problem, the inside of the tube is coated with a suitable phosphor which is activated by the ultraviolet radiation and, in turn, emits visible light of a color that is characteristic of the particular phosphor or mixture of phosphors employed to coat the tube. An important consideration in the operation of such fluorescent tubes is concerned with the fact that in order to sustain the arc across the tubes, the filament voltage must be maintained to a predetermined level. It is maintaining this predetermined voltage level and, at the same time, reducing the cost of components required to do so which poses the greatest problem in devising a scheme for dimming the output of the fluorescent tubes in a solid state ballast system to produce an energy-saving, light-dimming arrangement.

Solid-state ballasts must provide the same primary function as the conventional core-coil ballasts well known in the art, i.e. they must start and operate the lamp safely. Solid-state ballasts normally convert conventional 60 Hz AC to DC and then invert the DC to drive the lamps at a much higher frequency. That frequency generally is in the 10 to 50 KHz range. It has been found that fluorescent lamps which are operated at these higher frquencies have a higher energy efficiency than those operated at 60 Hz, and they exhibit lower power losses. In addition, at high frequencies, annoying 60 cycle "flickering" and ballast hum are eliminated.

Prior art electronic ballasts normally employ current fed inverters which require a transformer with a separate inductor and tuning capacitor in the primary circuit to obtain the proper tuned high frequency sine wave output. The inductor or choke coil normally has a ferrite core and is required to prevent the current to the transistor inverter from changing at the high 30 KHz inverter frequency so that an almost constant current is switched between the two transistors. The current waveform through them is trapezoidal rather than one exhibiting a high peak thereby keeping the transistor collector-to-emitter saturation voltage low. The choke coil also has a high impedance at the high inverter circuit frequency which helps reduce radio-frequency noise coupled to power lines.

These prior art devices, while somewhat successful, also have several drawbacks. The choke coil is an important functional part which is necessary to produce a high frequency tuned sinusoidal input in such prior art devices. However, it is an extremely costly element of the electronic ballast. Also, no practical low-cost method of dimming such circuits exists in the prior art.

SUMMARY OF THE INVENTION

By means of the present invention, many of the problems associated with component cost and dimming ability of prior art high frequency, solid state electronic ballasts are solved by the provision of an improved lower cost electronic ballast which allows dimming of the gas discharge tubes over a wide output range while maintaining safe, efficient operation of the lamps. The solid-state ballast of the present invention eliminates the need for the external primary inductance or choke coil of the prior art to accomplish tuned high frequency sinusoidal input. According to the present invention, a tuning capacitor is located in the secondary and the transformer of the ballast is constructed in a manner which harnesses the natural leakage inductance in the secondary such that both the inductance and capacitance normally on the primary side are on the secondary side. The secondary leakage inductance in conjunction with the tuning capacitor provide tuned sine wave output to the fluorescent lamps at the operating frequency of the inverter throughout the dimming range of the tubes. The tuned sine wave output greatly reduces radio frequency and electromagnetic interferences.

Auxiliary secondary windings may be used to maintain cathode heater filament voltage during dimming for fluorescent lamp applications. Dimming is accomplished by providing a variable pulse width modulated drive voltage to the inverter transistors or by reducing the supply AC voltage to the rectifying circuit which supplies the DC voltage to the invertor.

In an alternate embodiment, a self-oscillating half-bridge inverter is used in conjunction with a filtered full wave bridge rectifying system. To prevent any over-voltage or current from damaging transistors, tuning capacitors, or the like, in the system, when a lamp is removed with the system operating, a clamping circuit may be provided to limit the circuit voltage. This prevents the system voltage from exceeding the input voltage.

Another embodiment replaces, or partially replaces, the auxiliary secondary windings with one or more tuning capacitors in conjunction with the lamps to provide tuned sinusoidal input to the lamps and to maintain sufficient lamp filament heating voltage during dimming of the lamps. This embodiment also does not require the damping circuit.

BRIEF DESCRIPTION OF THE DRAWINGS

In the drawings wherein like numerals are utilized to denote like parts throughout the same.

DESCRIPTION OF THE ILLUSTRATED EMBODIMENTS

Figure 1:
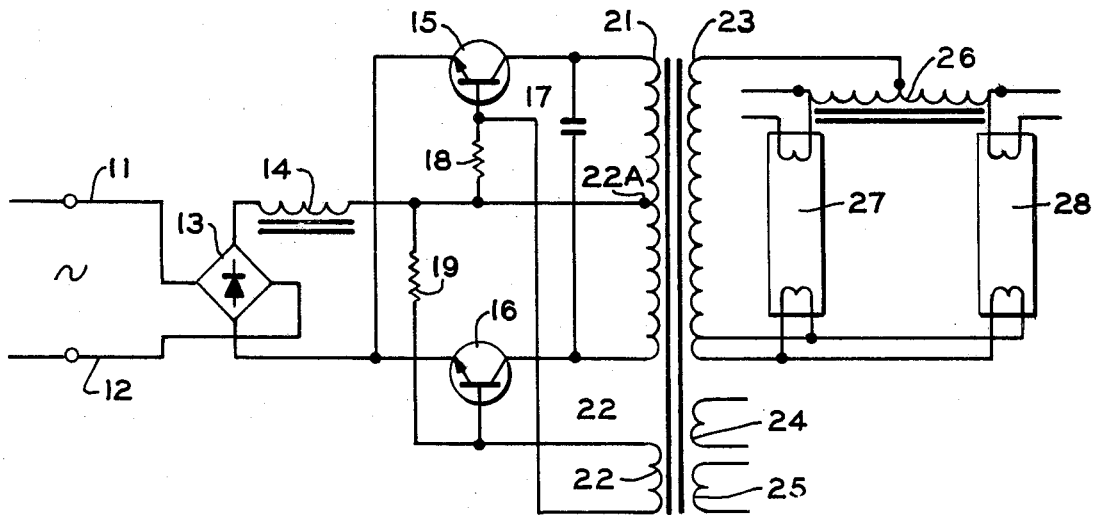
FIG. 1 is a diagram of a prior art electronic ballast utilizing a push-pull inverter circuit.

Reference is now made particularly to FIG. 1 which depicts a prior art electronic ballast arrangement which utilizes an external inductor or choke coil and tuning condensor in the primary circuit. The system includes a source of alternating current over lines 11 and 12, a rectifier 13, external inductor choke coil 14, and high-voltage power transistors 15 and 16 which, with primary tuning condensor 17 and resistors 18 and 19, provide tuned current-regulated input to ballast transformer 20 at primary winding 21 and positive feedback winding 22. The choke coil 14 is connected between rectifier 13 to a center tap on primary winding 22 at 22*a*. The configuration of the ballast secondary circuit is one illustrating a two-fluorescent tube configuration and includes a main secondary transformer winding 23 along with auxiliary secondary windings 24 and 25 and an additional center-tapped balancing coil in the secondary 26 which are connected to the filaments of tubes 27 and 28 in a well known fashion with respective a, b, c, and d terminals of the coils connected to the respective tube filaments as illustrated.

The ferrite core inductor coil 14 is designed to have a high impedance at the natural oscillation frequency of the two-transistor, push-pull inverter circuit including transistors 15 and 16 which operates at a typical oscillation frequency of 30 KHz. Any desired frequency can be used, however. This, of course, also helps to eliminate radio frequency noise which may be coupled to the power line input. The choke coil is utilized, in addition, to prevent the current to the transistor inverter circuit from changing at the inverter frequency such that an almost constant current is switched between the two transistors 15 and 16 and the current through them is a half wave trapezoidal current rather than one having a high peak. This keeps the transistor collector-to-emitter saturation voltage at a lower level. The tuning capacitor 17 provides a sine wave input at the transformer 20 which, in turn, produces a sinusoidal input waveform at the secondaries to operate the fluorescent tubes 27 and 28 properly.

Figure 2:
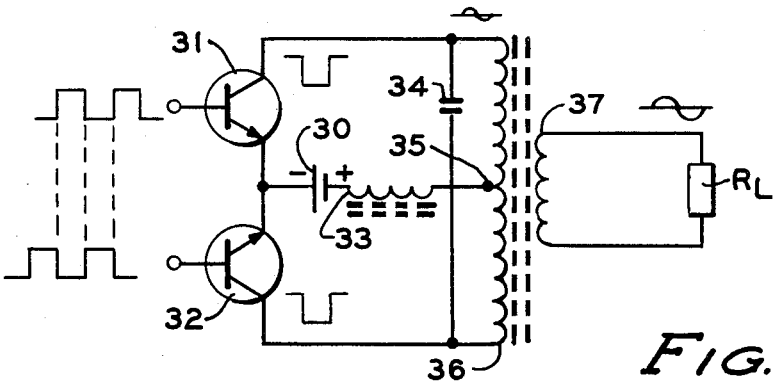
FIG. 2 is a simplified circuit diagram of a prior art electronic ballast of the type shown in FIG. 1.

FIG. 2 is a simplified equivalent circuit diagram of the current-fed, push-pull inverter ballast circuit of FIG. 1 including a source of full wave rectified AC current 30 which may be obtained from the AC circuit as by a full wave bridge such as that shown at 13 in FIG. 1. Input drive to the bases of transistors 31 and 32 is also indicated as alternate square waves. External inductor choke coil 33 in series with tuning capacitor 34 is connected between the junction of the emitters of transistors 31 and 32 and a center tap of the primary windings represented by 36 of the transformer. The capacitor 34 is connected across primary winding 36. As in FIG. 1, the bases of transistors 31 and 32 respectively are supplied with alternating square wave inputs and the choke coil and capacitor provide tuned sinusoidal input to the transformer 36. The secondary windings represented by 37 supply the input to the fluorescent or other gaseous discharge bulbs represented by $R_L$ connected across the secondary.

Figure 3:
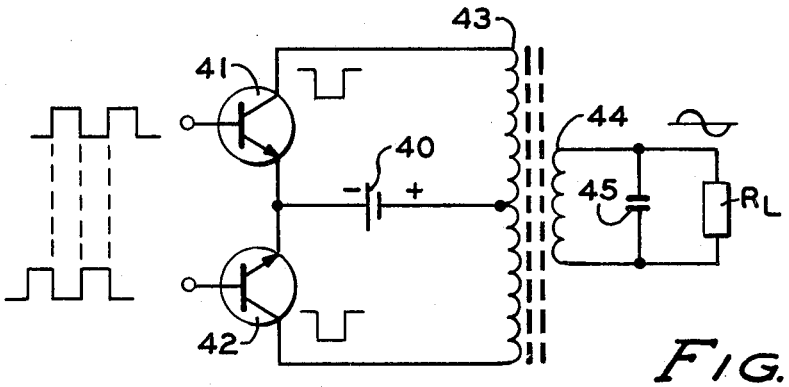
FIG. 3 is a simplified wiring diagram of an electronic ballast utilizing a portion of the teachings of the present invention.

The external inductor or choke coils represented by 14 in FIGS. 1 and 33 in FIG. 2, while necessary to the operation of those electronic ballast circuits, represents an expensive component in those circuits. FIG. 3 depicts a simplified circuit diagram which is functionally similar to that of FIG. 2 but which has the external inductance or ferrite choke coil eliminated from the primary inverter input circuit and the tuning capacitor connected across the secondary winding of the transformer in accordance with the present invention. Thus, there is shown in FIG. 3 at 40 a DC power supply, which may be obtained by rectification of the input AC current, and an external drive circuit, such as any readily available standard switching mode Power Supply (SMPS) drive integrated circuit not shown which provides alternate square wave input to power transistors 41 and 42 of a push-pull inverter circuit as indicated in the manner of FIGS. 1 and 2. This supplies square wave voltage to the primary winding 43 of ballast transformer. The transformer secondary winding is represented by 44 and sinusoidal input to the lamps represented by $R_L$ is obtained utilizing tuning capacitor 45 which resonates with the secondary leakage inductance of the transformers.

The above changes may be accomplished taking advantage of modifications to the ballast transformer made in accordance with the present invention in a manner similar to that accomplished in a conventional electric ballast in accordance with the inventor's above-referenced co-pending application Ser. No. 210,649, entitled "Two-wire Ballast for Fluorescent Tube Dimming." To the extent necessary that application is incorporated by reference herein. The technique contemplates eliminating the necessity of using additional expensive inductance components in the ballast system such as the choke coil by taking advantage of the natural leakage inductance of a modified transformer which is substituted for and functions in the same manner as the external inductance of the choke coil. Also, the transformer provides isolation between the lamps and the main power supply to provide an additional safety feature.

Figure 4:
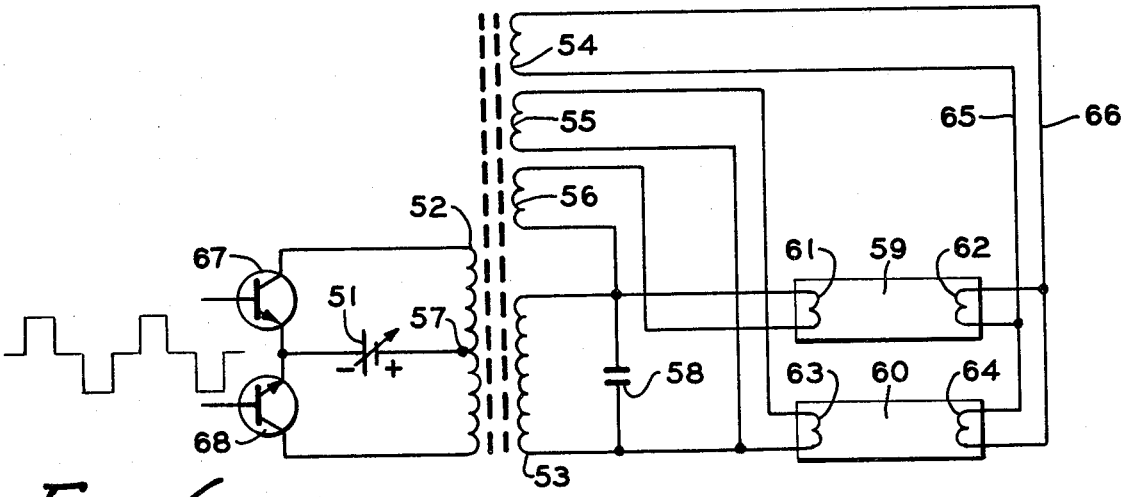
FIG. 4 is a circuit diagram in accordance with one embodiment of the present invention.

A more detailed drawing of one solid-state ballast circuit in accordance with the present invention utilizing a pulsed width modulated or variable voltage DC input drive to provide the dimming function in accordance with the invention is shown in FIG. 4. That embodiment is adapted for use with fluorescent lamps and includes a source of variable direct current indicated by 51 which may be derived from a variable AC line current varied in any well-known manner, e.g. by a phase controlled SCR/triac dimmer circuit as shown in FIG. 4*b*. which has been rectified in a conventional manner to provide the power supply to transistors 67 and 68 in a well-known manner as shown. The solid-state ballast of FIG. 4 further includes a transformer including primary winding 52, main secondary winding 53, and auxiliary secondary windings 54, 55, and 56. The ends of the primary winding 52 are connected across the collectors of push-pull transistors 67 and 68 and the variable current source between a center tap 57 of the primary winding 52 and the juncture of the emitters of transistors 67 and 68.

Figure 4A:
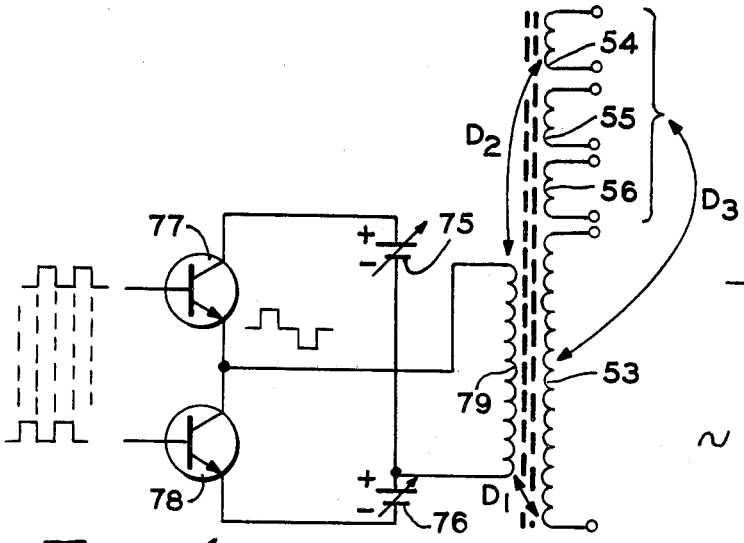
FIG. 4*a* is an alternate drive circuit for the embodiment of FIG. 4.
Figure 4B:
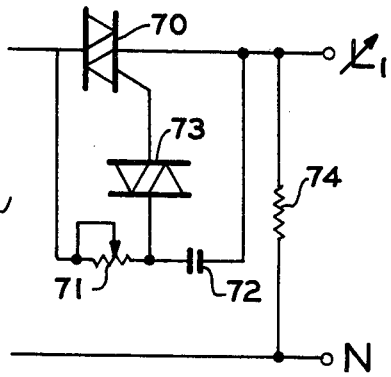
FIG. 4*b* is a typical dimming circuit for use with the ballast of the invention.

In the transformer construction, as illustrated in FIGS. 4 and 4*a* and as described more fully in the above-referenced co-pending application Ser. No. 210,649, the relative geometric distances between the primary transformer winding 52 and the main secondary winding 53 ($D_1$ in FIG. 4*a*), between the primary winding 52 and the auxiliary secondary windings 54–56 ($D_2$ in FIG. 4*a*), and between the main secondary winding 53 and the auxiliary secondary windings 54–56 ($D_3$ in FIG. 4*a*) are determined such that a tapping effect is created in the natural leakage inductance of the transformer. The windings are located relative to each other such that the corresponding voltage increases in the main secondary winding 53 associated with a voltage decrease to the transformer primary winding. The voltage in the auxiliary windings 54–56, however, remains substantially constant as these windings are placed in relation to both the primary and main secondary winding to offset changes in the system produced by dimming. This occurs because the resistance of the lamp increases as the power input decreases. Thus, the voltage at the filaments of the fluorescent tubes remains substantially constant throughout the dimming range. Once the spacial relationship is determined experimentally for any given application, it may be fixed in the construction of a particular ballast system.

The secondary side of the transformer also includes a tuning capacitor 58 together with the fluorescent tubes 59 and 60. The main secondary winding 53 is connected between filament 61 of fluorescent tube 59 and filament 63 of fluorescent tube 60. The tuning capacitor 58 is connected across the main secondary winding 53. Auxiliary secondary winding 56 is connected to the filament winding 61 of the fluorescent 59 and the auxiliary secondary winding 55 is connected across the filament winding 63 of the fluorescent tube 60. The third auxiliary secondary winding 54 is connected to the other filaments 62 and 64 of the fluorescent tubes 59 and 60, respectively, via conductors 65 and 66, as shown.

Dimming may be accomplished by any means for varying the pulse width of the input drive waveform or by modulating the input AC voltage to the rectification system to produce a variable DC at power at source 51. A conventional dimming circuit which is connected between a source of alternating current and the ballast. Such a circuit is shown in FIG. 4*b*. It may include a semiconductor switch or triac 70 having one side connected to one side of the alternating current source and the other side to the controlled line terminal $L_1$. A series combination of a variable resistor 71 and capacitor 72 connected across the triac 70 and a diac 73 connected from the junction of variable resistance 71 and capacitor 72 to the gate terminal of triac 70 are included. Further resistor 75 is connected from the junction of triac 70 and controlled line terminal $L_1$ to the junction on the other side of the alternating current source which connects terminal N in a well-known manner. As previously described, the dimming control circuit is a phase control circuit which controls the amount of current supplied to the controlled line terminal $L_1$ by varying the setting of variable resistor 71.

FIG. 4*a* represents an alternate embodiment of FIG. 4 of the invention using a modified circuit. The input circuit of FIG. 4*a* is known as a "half bridge" inverter circuit and includes separate DC sources 75 and 76 which may be supplied by alternate half-wave rectifications of a variable line input current utilizing a full wave bridge rectifying circuit. The circuit also includes power transistors 77 and 78 which are provided with a pulse width modulated input as from an SMPS-IC and which combine to produce a pulsed width modulated input to the primary winding 79 of the transformer. It should be noted that the transistors associated with the circuit of FIG. 4*a* need only accommodate one-half of the voltage required by the power transistors 67 and 68 of FIG. 4. Thus, the use of the half-bridge inverter enables the substitution of lower capacity, less expensive transistors which reduces the cost of the input circuit. The secondary circuit associated with FIG. 4*a* may be identical to that of FIG. 4 and therefore is shown only in part.

Figure 5:
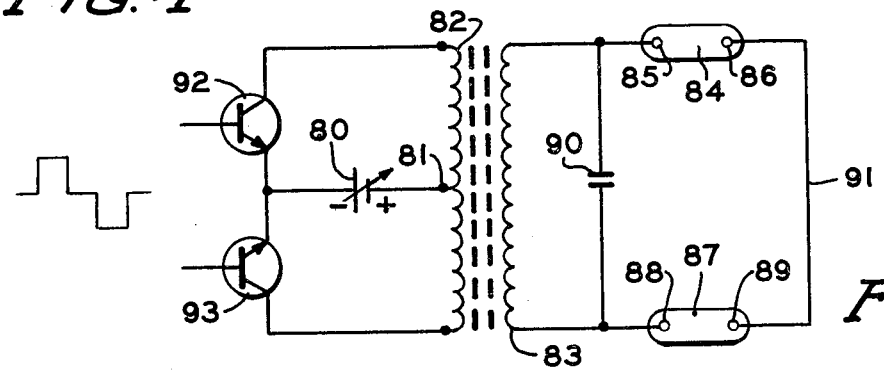
FIG. 5 represents an embodiment utilized to energize two pin fluorescent tubes or high intensity discharge lamps.

FIG. 5 is an alternate embodiment of FIG. 4 designed to power two-pin fluorescent tubes such as "slimline" tubes or high intensity discharge vapor lamps commonly in use today. Thus, the system includes a source modulated DC current 80 connected between a tap 81 on the transformer primary winding 82 and the two power transistors 92 and 93 which, in turn, are connected across the primary winding 82. A single secondary winding 83 supplies current to a lamp 84 having pins 85 and 86 and a lamp 87 having pins 88 and 89. A tuning capacitor 90 is also provided. The secondary winding 83 is located in relation to the primary as described above and is connected to input pins 85 and 88 of the lamps 84 and 87, respectively, and their remaining respective pins 86 and 89 are connected together by conductor 91. A tuning condensor 90 is connected across the secondary coil 83 as shown.

Figure 5A:
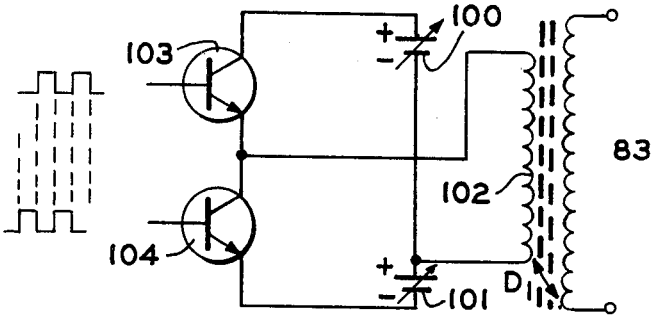
FIG. 5*a* represents an alternate drive circuit for the embodiment of FIG. 5.

FIG. 5*a* represents an alternative embodiment of the input circuit of FIG. 5 utilizing the half-bridge inverted as illustrated in FIG. 4*a*. This again includes variable DC sources 100 and 101, primary winding 102 along with power transistors 103 and 104 which provide a pulsed width modulated input.

Figure 6:
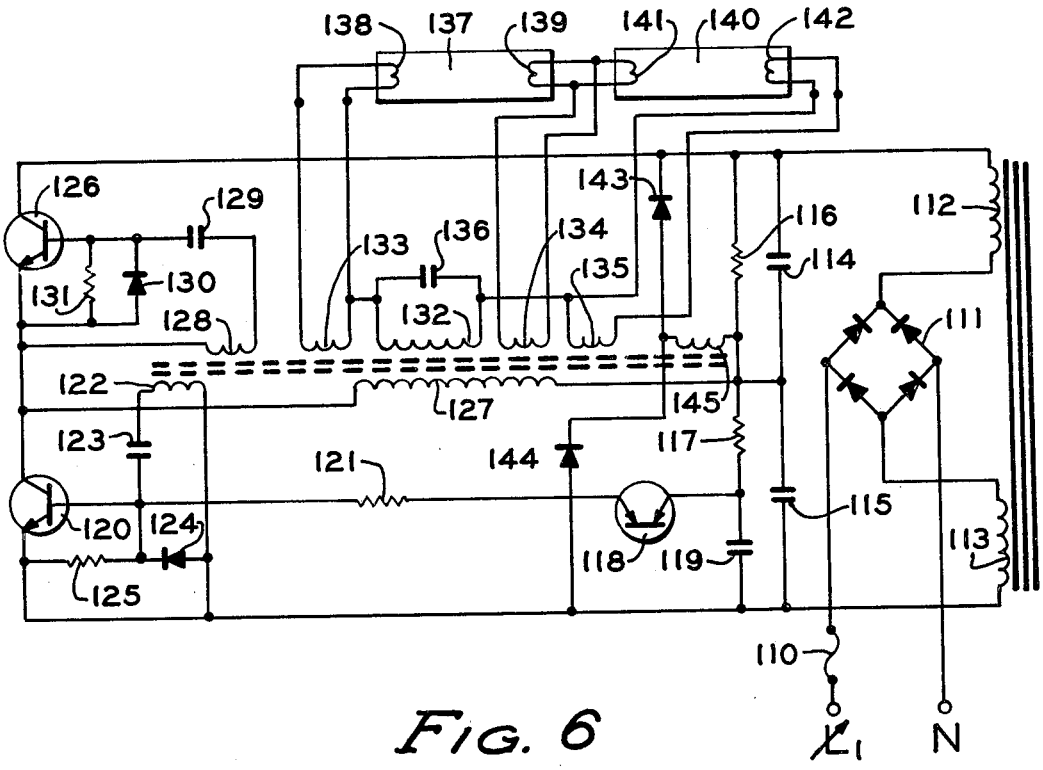
FIG. 6 represents an alternative embodiment of the electronic ballast system in accordance with the invention.

FIG. 6 depicts an alternate embodiment of the present invention in which the input is made self-oscillating by positive feedback. This configuration includes a conventional source of variable AC current such as that of FIG. 4*b* suitably fused or current limited at 110 is connected to a full wave rectifying bridge 111 which alternate rectified half waves of which are connected to filter inductors 112 and 113. Filter capacitors 114 and 115 are provided along with shunt resistors 116 and 117 which provide the rectified DC. The circuit further includes a triggering element 118 which may be a silicon unilateral switch, diac, or the like, an additional triggering capacitor 119. The output of the triggering element 118 is connected to the base of a first oscillator transistor 120 through a resistor 121. The emitter of the oscillator transistor 120 is further connected to a feedback coil arrangement which includes a coil 122, capacitor 123, diode 124, and resistor 125. The collector of transistor 120 is connected between the emitter of a second oscillator transistor 126 and the primary transformer winding 127. The base of the second half-bridge oscillator transistor 126 is also connected to positive feedback system including coil 128, capacitor 129, diode 130, and resistor 131.

The configuration further includes the main secondary winding 132 in the transformer along with auxiliary secondary windings 133, 134, and 135. A tuning capacitor 136 is connected across the main secondary winding 132. The system is illustrated as powering two fluorescent tubes including a first tube 137 having cathode filaments 138 and 139 and a second fluorescent tube 140 having cathode filaments 141 and 142. Secondary winding 132 is connected between the filament 138 of fluorescent tube 137 and the filament 142 of fluorescent tube 140. The auxiliary secondary winding 133 is also connected across the filament 138 of fluorescent tube 137, the auxiliary secondary winding 134 is connected across filaments 139 and 141 of the fluorescent tubes 137 and 140, and the auxiliary secondary winding 135 is connected across the cathode filament 142 of fluorescent tube 140 in the manner of FIG. 4. As in the case of FIG. 4, the distances between the primary transformer winding 127 and the main secondary winding 132, between the primary winding 127 and the auxiliary secondary windings 133, 134, and 135 and between the main secondary winding 132 and the auxiliary secondary windings 133, 134, and 135 are made such that the mutual leakage inductances of the transformer is utilized to maintain an essentially constant voltage at the lamp filaments despite changes in the primary winding input voltage which produce modulation of the brightness of the lamps.

In operation, the oscillation of the half-bridge inverter system is initiated by charging capacitor 119 through resistor 117. When the triggering voltage value is reached, the triggering element 118 discharges capacitor 119 through resistor 121 into the base of transistor 120 thereby turning on transistor 120 turning on transistor and the system including transistor 126 begins oscillating at its natural frequency. Subsequent discharges from capacitor 119 through element 118 are too small to affect the half-bridge inverter oscillator once oscillation has begun. The system, then, provides a sine wave input at the natural oscillating frequency of the half-bridge inverter circuit to the fluorescent tubes 137 and 140 as determined by the leakage inductance of the main secondary winding 132 and capacitor 136.

To protect the secondary tuning capacitor 136, along with the transistors 120 and 126 from an over-voltage and over-current condition when one of the tubes 137 or 140 is removed while the system is operating, a clamping circuit is provided which includes series connected diodes 143 and 144 along with an additional coil 145 which is connected from a point between the two series diodes to a point between the resistors 116 and 117 of the input filter circuitry. In this manner, whenever an open circuit appears between the sets of filaments of tube 137 or 140, the two diodes 143 and 144 along with coil 145 "clamp" the voltage to the level of the input capacitors 114 and 115 of the DC power supply.

Figure 7:
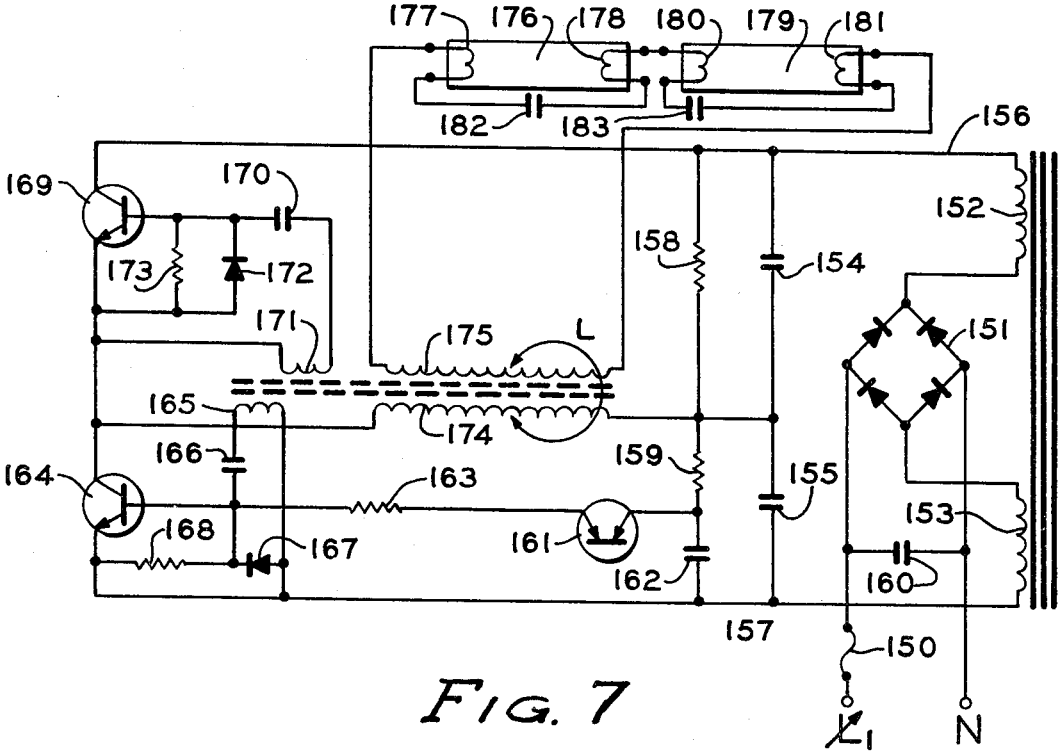
FIG. 7 represents another alternate embodiment of the electronic ballast configuration in accordance with the invention.

FIG. 7 depicts yet another, more simplified, embodiment of the electronic dimmable ballast in accordance with the present invention. The embodiment of FIG. 7 includes typical controlled line AC input which may be identical with that of FIG. 4*b* having a fuselink or thermoresponsive switch as at 150. The input is connected to full wave bridge amplifier 151 which connects rectified alternate half waves with rectifying filter inductors 152 and 153, respectively. As with the embodiment of FIG. 6, the rectifying filter circuit further includes rectifying filter capacitors 154 and 155 connected across lines 156 and 157, along with shunt resistors 158 and 159. A further input capacitor 160 may also be provided across the AC input lines, for radio frequency interference suppression. As in the case of FIG. 6, a self-starting, half-bridge inverter system is provided including triggering element 161, triggered capacitor 162, and resistor 163 which discharges into the base of transistor 164. The base and emitter of transistor 164 are connected by a positive feedback loop including coil 165, capacitor 166, diode 167, and resistor 168. The second power transistor 169 is provided with a positive feedback circuit including capacitor 170, feedback coil 171, diode 172, and resistor 173. The primary transformer winding 174 is connected, as in FIG. 6, between the rectified input voltage and the juncture between the collector of transistor 164 and the emitter of transistor 169 such that the full sine wave current is provided to the single secondary winding 175. The secondary is used to power fluorescent tube 176 having filament windings 177 and 178 and fluorescent tube 179 having filament windings 180 and 181.

Capacitors 182 and 183 connected across the filaments fo fluorescent tubes 176 and 179, respectively, are also provided in this embodiment. Capacitors 182 and 183 are utilized to provide tuned sinusoidal input to the lamps and provide substantially constant filament voltage input during dimming. While this eliminates the need for the auxiliary secondary windings, it should be noted, however, that voltage control is somewhat less with this configuration than with the leakage transformer system of FIGS. 4 and 6. The capacitors 182 and 183 are also used to control the voltage in the circuit when either tube 176 or 179 is removed during the operation of the circuit such that none of the components will be subject to over voltage. These capacitors, then, also take the place of the clamping circuit of FIG.

6 providing the necessary protection. The secondary transformer winding 175 is located with respect to the primary winding 174 of the filament power transformer in the manner described above such that leakage inductance of the transformer may be utilized to eliminate the need for any additional inductance in the secondary circuit of the system. While they do not provide voltage control as accurate as the auxiliary windings, the capacitors 182 and 183 provide reasonable control over the filament voltage during dimming of the fluorescent tubes 176 and 179. Some increase in voltage may be noted during dimming which may be beneficial for the lamps in some applications.

The embodiment of FIG. 7 has been found to work best with a low power lamp load, i.e. less than about 40 watts and/or a relatively high AC input voltage, i.e. 220 volts or above. However, at lower supply voltages or with higher load ratings, overheating of the cathode filaments might occur because the resonant circuit current may exceed the rating of the cathode filament. Accordingly, where desired, an alternate embodiment may be used which is somewhat more costly but which overcomes the above limitation and can be used for any application. That embodiment is shown in FIG. 8.

Figure 8:
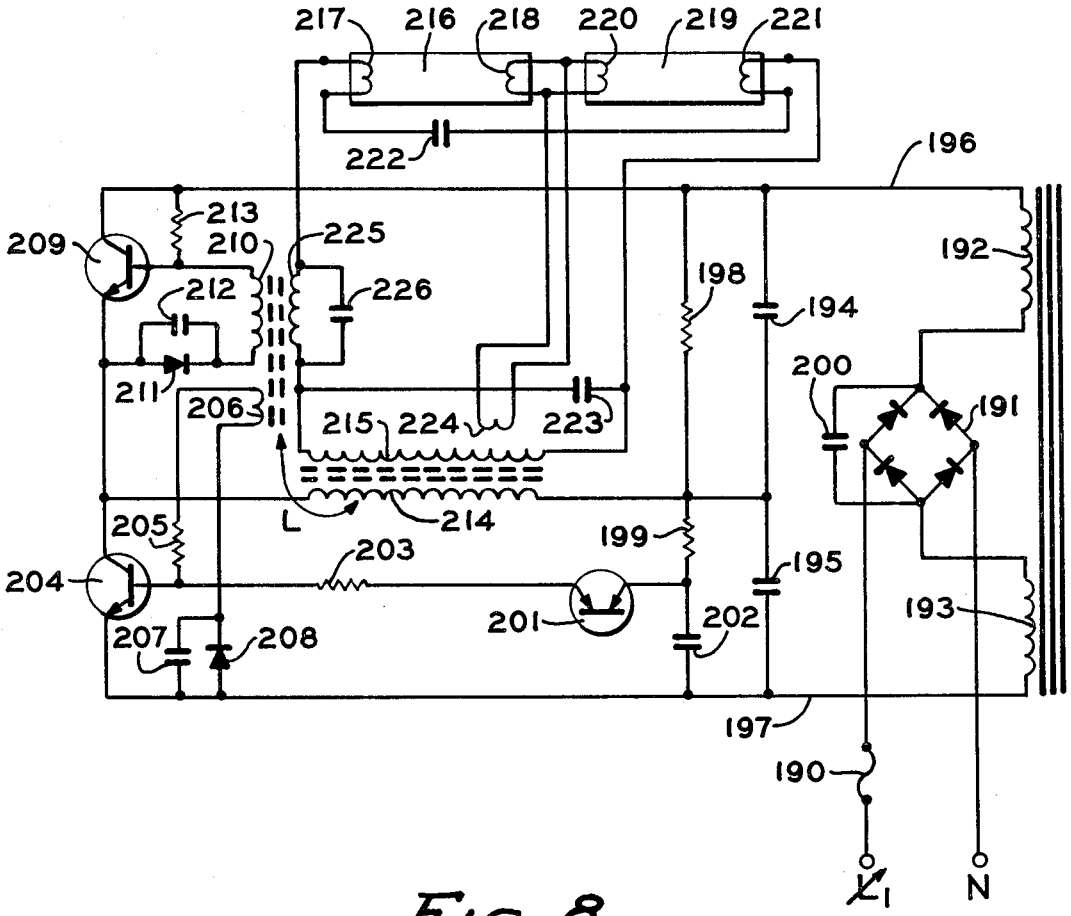
FIG. 8 represents an alternate embodiment to that of FIG. 7 with more universal application.

The embodiment of FIG. 8 includes typical controlled line AC input which may be identical with that of FIG. 4*a* used in conjunction with FIG. 7 having a fuselink or thermoresponsive switch as at 190. The input is connected to full wave bridge rectifier 191 which connects rectified alternate half waves with rectifying filter inductors 192 and 193, respectively. As with the embodiment of FIG. 6 or 7, the rectifying filter circuit further includes rectifying filter capacitors 194 and 195 connected across lines 196 and 197, along with shunt resistors 198 and 199. A further input capacitor 200 may also be provided across the rectifier output lines, for radio frequency interference suppression. As in the case of the embodiment of FIG. 7, a self-starting, half-bridge inverter system is provided including triggering element 201, trigger capacitor 202, and resistor 203 which discharges into the base of transistor 204. The base and emitter of transistor 204 are connected by a positive feedback loop including resistor 205, coil 206, capacitor 207, and diode 208. The second power transistor 209 is likewise provided with a positive feedback circuit including feedback coil 210, diode 211, and capactior 212. An additional starting resistor may be provided at 213. The primary transformer winding 214 is connected, as in FIGS. 6 and 7, between the rectified input voltage and the juncture between the collector of transistor 204 and the emitter of transistor 209 such that the full sine wave wave current is provided to the secondary winding 215. The secondary is illustrated as powering fluorescent tube 216 having filament windings 217 and 218 and fluorescent tube 219 having filament windings 220 and 221.

A capacitor 222 is connected across the filaments of fluorescent tubes 216 and 219, respectively, and a capacitor 223 is also provided in this embodiment connected across secondary winding 215. Capacitors 222 and 223 are utilized to split up the resonant current while providing tuned sinusoidal input to the lamps. This splitting effect prevents any over-current from overheating the lamp filaments. A single auxiliary secondary winding 224 may be connected across filaments 218 and 220 which, with capacitors 222 and 223, provides substantially constant filament heating voltage input during dimming. This replaces the second capacitor across the tube filaments of FIG. 7 but such can be used if desired for some applications instead of coil 224.

In order to terminate oscillation of the circuit when a lamp is removed to prevent over-voltage or over-current from damaging any of the circuit elements, an additional tuned circuit including coil 225 and capacitor 226 is provided. This tuned circuit is constructed so as to have the same resonant frequency as the circuit including the leakage inductance of coil 215 and and capacitors 222 and 223. Thus, where $\omega_0 = 2\pi \times$ the resonant frequency of the system (cycles per second)

L = inductance (henrys)

C = capacitance (farads)

$$\omega_0 = \frac{1}{\sqrt{L_{225}C_{226}}} = \frac{1}{\sqrt{L_{215}(C_{222} + C_{223})}}$$

Normally, the fluorescent or other gas discharged lamps associated with the embodiments of FIGS. 6, 7, and 8 are dimmed by simply utilizing a system to decrease the AC input voltage as described in relation to FIG. 4*a*. However, any type of rheostatic device or other commonly used pulse width modulated drive circuit compatible with the system can be utilized.

It should be noted that although the inverter circuits described in relation to the present invention have a nominal resonant frequency in the range of about 30 KHz, any suitable source having a frequency above about 400 Hz will operate the ballast of the present invention.

The embodiments of the invention in which an exclusive property or right is claimed are defined as follows:

1. A two-wire electronic ballast arrangement for one or more gas discharge lamps dimming comprising:

a source of direct current;

a source of variable square wave electric power;

transistor inverter means adapted to be fed by said source of variable square wave electric power;

transformer means comprising at least a first primary winding connected to said inverter and said source of direct current, a first secondary winding for supplying power to one or more gas discharge lamps, auxiliary secondary windings connected across the heating filaments of each gas discharge lamp, said first and said auxiliary secondary windings being disposed in predetermined spaced relation to said primary winding and said auxiliary secondary windings being disposed in predetermined spaced relation to said first secondary winding such that the voltage supplied to the heating filaments of said one or more gas discharge lamps remain substantially constant during variation of the voltage to said primary;

tuning capacitor means connected across said first secondary winding selected to be in resonance with the leakage inductance of said first secondary winding to produce tuned sinusoidal input to said one or more lamps.

2. The apparatus of claim 1 wherein said capacitor and said first secondary winding are resonant at the frequency of said inverter.

3. The apparatus of claim 1 wherein said source of direct current is variable.

4. The apparatus of claim 1 wherein said variable square wave electric power is pulse width modulated power and wherein said transistor inverter is a two-transistor, push-pull inverter.

5. The apparatus of claim 4 including first and second series connected windings in said primary winding of said transformer connected across the collectors of said transistors in said inverter and wherein said source of direct current is connected between the common of the emitters of said transistors and a point between said series windings.

6. The apparatus of claim 5 wherein said first and second primary transformer windings are created by a center tap in a single winding.

7. The apparatus of claim 1 wherein said transistor inverter means is a half-bridge inverter adapted to produce a pulse width modulated drive in said primary winding.

8. The apparatus of claim 7 wherein said half-bridge inverter is self-oscillating.

9. The apparatus of either of claims 3 or 7 wherein dimming is achieved by voltage variation of said direct current.

10. The apparatus of claim 1 wherein said variable square wave power is pulse width modulated and wherein dimming is achieved by varying the pulse width.

11. The apparatus of any of claims 2–4 or 7 wherein said first secondary winding has terminals connected to the filaments of a fluorescent tube, and and wherein one of said auxiliary secondary windings has terminals connected across one of said fluorescent filaments, and another of said auxiliary secondary windings has terminals connected across the other of said fluorescent filaments.

12. The apparatus of any of claims 2–4 or 7 wherein said first secondary winding has terminals connected to a first filament of each of two fluorescent lamps and wherein one of said auxiliary secondary windings has terminals connected across one of said first filaments of one of said two fluorescent lamps, another of said auxiliary secondary windings has terminals connected across the first filament of the other of said two fluorescent lamps, and fourth secondary winding connected in parallel across the second filament of both of said fluorescent lamps.

13. A two-wire electronic ballast arrangement for fluorescent dimming comprising:

a source of variable direct current;

self-oscillating series-transistor half-bridge inverter means connected across said source of direct current;

transformer means having a primary winding connected from a point between the series transistors of said inverter and said direct current, first secondary winding having terminals connected to the heating filaments of a fluorescent lamp, second secondary winding having terminals connected across one of said fluorescent heating filaments;

third secondary winding having terminals connected across the other of said fluorescent heating filaments;

wherein said second and third secondary windings are disposed in predetermined spaced relation to said primary winding and said first secondary winding and said first secondary winding is disposed in predetermined spaced relation to said primary winding such that the voltage supplied to the heating filaments of said fluorescent lamp during variation of the source power remains substantially constant; and tuning capacitor means connected across said first secondary winding to produce sinusoidal input to said fluorescent lamp.

14. The apparatus of claim 13 wherein said first secondary winding has terminals connected to a first filament of each of two fluorescent lamps and wherein said second secondary winding has terminals connected across the first filament of one of said two fluorescent lamps, and said third secondary winding has terminals connected across the first filament of the other of said two fluorescent lamps, and including a fourth secondary winding connected in parallel across the second filaments of both of said fluorescent lamps.

15. The apparatus according to either of claims 13 or 14 further comprising:

voltage limiting means for limiting the voltage in said half-bridge inverter circuit when said lamps are removed, said voltage limiting circuit comprising:

series diodes connected across said source of full wave rectified direct current, and coil means connected from a point between said pair of series diodes and a point in series with said primary transformer winding in proximity to the core of said transformer.

16. The apparatus of either of claims 13 or 14 wherein said dimming is accomplished by the input to said source of full wave rectified direct current.

17. A two-wire electronic ballast arrangement for fluorescent dimming comprising:

a source of variable direct current;

self-oscillating, series-transistor, half-bridge inverter means connected across said source of DC current;

transformer means having a primary winding connected from a point between the series transistors of said inverter and said source of DC current and secondary winding having terminals connects to one terminal of each of the filaments of a fluorescent lamp;

first turning capacitor means connected across said secondary winding;

second tuning capacitor means connected across the remaining terminals of each of the filaments of the fluorescent lamp to produce with said first tuning capacitor and said secondary winding tuned sinusoidal input to said lamp and to control variation in the voltage across the heating cathodes upon dimming of the lamp; and auxiliary tuned circuit means having an inductor and capacitor connected in parallel in series with said secondary winding wherein said auxiliary tuned circuit means is tuned to the same frequency as input to said lamp and adapted to prevent oscillation of said inverter upon removal of said lamp during operation of the ballast.

18. The apparatus of claim 17 wherein said secondary winding is connected across a plurality of series connected fluorescent lamps and wherein said second tuning capacitor is connected across the remaining terminals of the same filaments of said series connected lamps as said secondary winding, said apparatus further comprising:

auxiliary secondary winding means connected across the interconnected filaments of said series connected fluorescent lamps.

19. The apparatus of either of claims 17 or 18 wherein said self-oscillating inverter means includes positive feedback coils which share a common core with the inductor of said auxiliary tuned circuit such that oscillation of said inverter stops when a lamp is removed during the operation of the ballast.

20. The apparatus of either of claims 17 or 18 wherein said source of variable direct current is a full-wave bridge rectifier.

21. The apparatus of claim 20 wherein dimming of said lamps is accomplished by varying the AC input to said rectifier.

22. A two-wire electronic ballast arrangement for fluorescent dimming comprising:

a source of variable direct current;

self-oscillating series-transistor half-bridge inverter means connected across said source of direct current;

transformer means having a primary winding connected from a point between the series transistors of said inverter and said source of direct current and secondary winding having terminals connected to one terminal of each of the filaments of a fluorescent lamp, and tuning capacitor means connected across the remaining terminals of each of the filaments of the fluorescent lamp to produce sinusoidal input to said lamp and to control with said secondary winding variation in the voltage across the heating cathodes upon dimming of the lamp or in the circuit upon removal of said lamp.

23. The apparatus of claim 22 wherein said secondary winding is connected across a plurality of series connected fluorescent lamps and wherein one of said tuning capacitors is provided and connected across each of said series connected lamps.

24. The apparatus of either of claims 22 or 23 wherein said source of variable direct current is a full wave rectifier.

25. A two-wire electronic ballast arrangement for high intensity discharge lamp dimming wherein said lamps have a single terminal per cathode comprising:

a source of direct current;

a source of variable square wave electric power;

transistor inverter means adapted to be fed by said square wave electric power;

transformer means including a primary winding connected to said inverter and a secondary winding connected across one or more high intensity discharge lamps said transformer being constructed in a manner such that its natural leakage inductance appears in the secondary; and tuning capacitor means connected across said secondary winding to provide with said leakage inductance of said transformer a tuned circuit which provides tuned sinusoidal input to said one or more lamps.

26. The apparatus of claim 25 wherein said drive source of square wave electric power is a pulse width modulated drive and said inverter means is a push-pull inverter.

27. The apparatus of claim 25 wherein said source of square wave electric power is a pulse width modulated drive, and said inverter is a half-bridge inverter.

28. The apparatus of either of claims 26 or 27 wherein said dimming is achieved by modulation of the pulse width.

29. The apparatus of claim 25 wherein said source of DC current is a full wave rectifier means and said dimming is achieved by varying AC input to said rectifier.

* * * * *